US005954906A

United States Patent [19]

Abe et al.

[11] Patent Number: 5,954,906

[45] Date of Patent: Sep. 21, 1999

[54] PRESSURE-SENSITIVE TRANSFERRING PROTECTIVE COVERING MATERIAL AND METHOD FOR PROTECTING AND COVERING A PRINT FORMED OF A DYE ON AN OBJECT WITH THE USE OF SAID MATERIAL

[75] Inventors: Tsutomu Abe, Isehara; Eiichi Suzuki, Asaka; Mamoru Sakaki, Yamato; Hiromichi Noguchi, Hachiouji; Keisuke Matsuo, Yokohama; Mifune Hirose, Machida; Kenichi Moriya, Tokyo, all of Japan

[73] Assignee: Canon Kabushiki Kaisha, Tokyo, Japan

[21] Appl. No.: 08/851,273

[22] Filed: May 5, 1997

Related U.S. Application Data

[63] Continuation of application No. 08/569,928, Dec. 8, 1995, abandoned.

[30] Foreign Application Priority Data

Dec. 9, 1994 [JP] Japan ..... 6-305819
Nov. 24, 1995 [JP] Japan ..... 5-305387

[51] Int. Cl.[6] ..... B41M 5/00

[52] U.S. Cl. ..... 156/247; 428/41.5; 428/41.7; 428/42.1; 428/195; 428/423.1; 428/447; 428/500

[58] Field of Search ..... 156/247; 428/40.1, 428/41.5, 41.7, 42.1, 195, 423.1, 447, 500, 914

[56] References Cited

U.S. PATENT DOCUMENTS

| | | | |
|---|---|---|---|
| 4,756,963 | 7/1988 | Yamamoto et al. | 428/334 |
| 4,780,348 | 10/1988 | Yamamoto et al. | 428/43 |
| 4,785,313 | 11/1988 | Higuma et al. | 346/135.1 |
| 4,926,190 | 5/1990 | Laver | 346/1.1 |
| 5,089,050 | 2/1992 | Vieira et al. | 106/20 |
| 5,124,723 | 6/1992 | Laver | 346/1.1 |
| 5,261,953 | 11/1993 | Vieira et al. | 106/20 R |

*Primary Examiner*—Bruce H. Hess
*Attorney, Agent, or Firm*—Fitzpatrick, Cella, Harper & Scinto

[57] ABSTRACT

A pressure-sensitive transferring protective covering material comprising at least (a) first flexible substrate, (b) an adhesive layer, (c) a solid resin layer, and (d) a second flexible substrate which are stacked in the named order, wherein said first flexible substrate (a) has a peel force of 30 g/inch to 120 g/inch against said adhesive layer (b), said adhesive layer (b) contains a hindered amine series light stabilizer and has a cohesion of 500 g/inch to 1500 g/inch, said solid resin layer (c) comprises a transparent resin layer containing a ultraviolet absorber and having a glass transition temperature of 50° C. or above, and said second flexible substrate (d) has a peel force of 120 g/inch to 400 g/inch against said solid resin layer (c).

A method for protecting and covering a print formed on an object using said pressure-sensitive transferring protective covering material.

40 Claims, 1 Drawing Sheet

PRESSURE-SENSITIVE TRANSFERRING PROTECTIVE COVERING MATERIAL AND METHOD FOR PROTECTING AND COVERING A PRINT FORMED OF A DYE ON AN OBJECT WITH THE USE OF SAID MATERIAL

This application is a continuation of application Ser. No. 08/569,928, filed Dec. 8, 1995, now abandoned.

BACKGROUND OF THE INVENTION

1. Field of the Invention

The present invention relates to a novel pressure-sensitive transferring protective covering material which enables to prevent a print formed of a dye, particularly, a print formed by means of an ink jet system using a dye from being deteriorated by light. More particularly, the present invention relates to a novel pressure-sensitive transferring protective covering material in the form of a film, which can be used in a manner of transferring it onto an object having a print formed of a dye thereon so that the print is prevented from being deteriorated by light. The present invention also relates to a method for protecting and covering a print formed of a dye on an object using said pressure-sensitive transferring protective covering material, whereby preventing the print from being deteriorated by light.

2. Related Background Art

It is known that dyes used for ink jet printing are insufficient in terms of light fastness, and as for a print formed on a so-called ink jet printing paper comprising a coated paper having a pigment-containing coat disposed on a base paper by way of ink jet printing using such dye, though the print is good enough in quality, it is insufficient in light stability or fade resistance and because of this, it is liable to gradually fade or discolor after some time. This is due to the fact that a cationic functional group-bearing cationic polymer as a water proof agent is usually contained in the coat of the ink jet printing paper for the purpose of fixing a dye in the coat. Particularly, the cationic functional group of such cationic polymer provides a negative effect for the release of an energy generated as a result of photo reaction and because of this, the cationic polymer is liable to reduce the light resistance of the dye.

In order to eliminate these problems, U.S. Pat. Nos. 4,926,190, 5,089,050, 5,124,723, and 5,261,953 propose various light stabilizers for use in inks or printing papers for ink jet printing.

According to the specifications of these U.S. patents, it is understood that the use of these light stabilizers provides a reasonable effect in terms of stabilization against light. However, the extent of the effect provided by such stabilizer is not of a satisfactory level in comparison with a light stabilization effect provided in the case of using a conventional printing ink.

The reasons for this can be considered as will be described below.

(1) In general, in the case where a light stabilizer is contained in a printing paper, a dye applied to the printing paper substantially remains on the surface thereof and because of this, only a part of the amount of the stabilizer effects the dye. In addition, the light stabilizer added is substantially present in the printing paper and because of this, it does not function as a filter while remaining on the surface of the printing paper.

(2) Further, in the case where a light stabilizer is contained in an aqueous ink, as the light stabilizer is usually not high in solubility against the aqueous ink, and even in the case where it should be resolved in the aqueous ink, and therefore, as for the light stabilizer, there is a limit in terms of compatibility with other components of the ink. Because of this, the light stabilizer which comes to effectively work on the surface of a printing paper is not of a sufficient rate in comparison with the amount of the light stabilizer added.

For these reasons, only several of the light stabilizers disclosed in the above U.S. patent documents have been practically used in inks or printing papers for ink jet printing.

Separately, in order to improve the light stability of a print formed with a dye on a printing paper, there has been proposed a method of covering the print by a protective material film, wherein the protective material film is superposed on the print-bearing surface of the printing paper so as to cover the print. According to this method, there can be attained a certain improvement in the fastness of the print and also in the texture of the printing paper. As such protective material film, various protective material films are commercially available.

However, as for this method, there are problems such that as the protective material film itself is laminated directly on the print, the texture of the printing paper is liable to undesirably change and in addition to this, the method is still insufficient in order to improve the light resistance of the print.

SUMMARY OF THE INVENTION

An object of the present invention is to eliminate the problems found in the prior art.

Another object of the present invention is to provide a novel pressure-sensitive transferring protective covering material which enables to improve the light resistance of a print formed on an object such as a printing paper with a dye while maintaining the texture of the printing paper in a desirable state and which also enables to conduct lamination treatment for the print-bearing surface of the object at room temperature.

A further object of the present invention is to provide a method for protecting and covering a print formed on an object such as a printing paper with a dye by using the above described protective covering material.

DESCRIPTION OF THE INVENTION AND PREFERRED EMBODIMENTS

Figure 1:
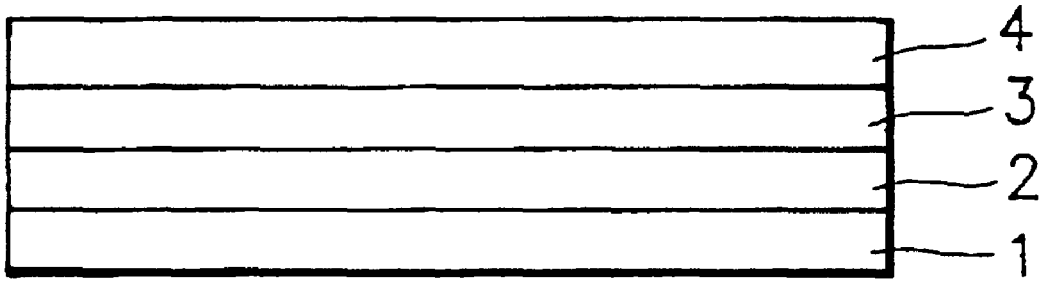
FIG. 1 is a schematic cross-sectional view of the constitution of an example of a pressure-sensitive protective covering material according to the present invention.

The present invention attains the above described objects.

An embodiment of the present invention is directed to a novel pressure-sensitive transferring protective covering material comprising at least (a) a first flexible substrate, (b) an adhesive layer, (c) a solid resin layer, and (d) a second flexible substrate, which are stacked in the named order, wherein said first flexible substrate (a) has a peel force of 30 g/inch to 120 g/inch against said adhesive layer (b), said adhesive layer (b) contains a hindered amine series light stabilizer and has a cohesion of 500 g/inch to 1500 g/inch, said solid resin layer (c) comprises a transparent resin layer containing a ultraviolet absorber (or a UV absorber) and having a glass transition temperature of 50° C. or above, and said second flexible substrate (d) has a peel force of 120 g/inch to 400 g/inch against said solid resin layer (c).

Another embodiment of the present invention is directed to a method for protecting and covering a print formed on an object (for example, a printing paper) with a dye, said method comprising the steps of:

(i) providing a pressure-sensitive transferring protective covering material comprising at least (a) a first flexible substrate, (b) an adhesive layer, (c) a solid resin layer, and (d) a second flexible substrate which are stacked in the named order wherein said first flexible substrate (a) has a peel force of 30 g/inch to 120 g/inch against said adhesive layer (b), said adhesive layer (b) contains a hindered amine series light stabilizer and has a cohesion of 500 g/inch to 1500 g/inch, said solid resin layer (c) comprises a transparent resin layer containing a ultraviolet absorber (or a UV absorber) and having a glass transition temperature of 50° C. or above, and said second flexible substrate (d) has a peel force of 120 g/inch to 400 g/inch against said solid resin layer (c);

(ii) superposing the adhesive layer (b) of the protective covering material on the print-bearing surface of the object while peeling the first flexible substrate (a) at room temperature, whereby contacting the adhesive layer to the print-bearing surface to cover the print-bearing surface; and (iii) peeling the second flexible substrate to obtain a print product.

The present invention enables to markedly improve the light resistance of a print formed on an object such as printing paper with a dye while maintaining the texture of the printing paper in a desirable state and it also enables to conduct lamination treatment for the print-bearing surface of the object at room temperature. Therefore, according to the present invention, there can be attained a desirable print product which is hardly deteriorated even in the case where it is stored over a long period of time.

In the following, a detailed description will be made of the pressure-sensitive transferring protective covering material according to the present invention.

The pressure-sensitive transferring protective covering material according to the present invention is typically of the constitution shown in FIG. 1.

FIG. 1 is a schematic cross-sectional view of the constitution of an example of the pressure-sensitive transferring protective covering material according to the present invention.

The pressure-sensitive transferring protective covering material shown in FIG. 1 comprises a first flexible substrate 1, an adhesive layer 2, a solid resin layer 3, and a second flexible substrate 4, which are stacked in the named order, wherein said first flexible substrate 1 has a peel force of 30 g/inch to 120 g/inch against said adhesive layer 2, said adhesive layer 2 contains a hindered amine series light stabilizer and has a cohesion of 500 g/inch to 1500 g/inch, said solid resin layer 3 comprises a transparent resin layer containing a UV absorber and having a glass transition temperature of 50° C. or above, and said second flexible substrate 4 has a peel force of 120 g/inch to 400 g/inch against said solid resin layer 3.

Detailed description will be made of each constituent of the pressure-sensitive transferring protective covering layer according to the present invention.

First Flexible Substrate

The first flexible substrate is required to have a property of allowing a composite comprising the adhesive layer, solid resin layer and second flexible substrate disposed thereon to be surely peeled therefrom. That is, the first flexible substrate is required to have a desired peel force against the adhesive layer. Particularly, the first flexible substrate is desired to comprise a material of exhibiting a peel force preferably in the range of 30 g/inch to 120 g/inch or more preferably, in the range of 50 g/inch to 80 g/inch in the 180° peel test. The peel force should be properly determined depending upon the interrelation between the action of the first flexible substrate and that of the adhesive layer.

As for the peel force for the first flexible substrate in the above range, it was obtained through experiments by the present inventors. That is, a plurality of composites each comprising a given flexible substrate and a given adhesive layer disposed on said flexible substrate were provided. Each composite was bonded on a surface of a glass plate through the adhesive layer to thereby obtain a plurality of stacked samples. Each stacked sample was subjected to the 180° peel test using a tension testing machine wherein the flexible substrate was peeled from the adhesive layer at room temperature and under conditions of 180° for the peel angle and 3 cm/sec for the peel rate, wherein a force required to peel the flexible substrate from the adhesive layer was obtained for each stacked sample. The peel force in the above range was obtained based on the results thus obtained. As a result of further experiments by the present inventors, it was found that when the peel force exceeds 120 g/inch, there is a tendency that the second flexible substrate is likely to peel before the first flexible substrate is peeled from the adhesive layer.

Specific examples of the constituent material of the first flexible substrate which satisfies the condition of the above peel force include films of polyethylene, films of polypropylene, films of vinylidene chloride-vinyl chloride copolymer, papers coated with polyethylene wax or silicone lubricant to their surface, synthetic papers, films of polyethylene terephthalate, and composite members of these.

Adhesive Layer

As above described, the pressure-sensitive transferring protective covering material according to the present invention is used for the purpose of protecting a print formed on an object such as printing paper with a dye. Therefore, the adhesive layer is desired to basically comprise an adhesive which is transparent and excels in weatherability. As such adhesive, there can be mentioned high molecular acrylic adhesives which contain no plasticizer and are reactive with a crosslinking agent such as isocyanates, epoxy resins or the like.

As above described, the adhesive layer contains a hindered amine series light stabilizer.

In the present invention, it is the most desirable for the adhesive layer to be comprised of a composition of the above acrylic adhesive as the main component and said hindered amine series light stabilizer because the acrylic adhesive is desirably compatible with the hindered amine series light stabilizer.

The adhesive layer is designed to have a cohesion preferably in the range of 500 g/inch to 1500 g/inch or more preferably, in the range of 700 g/inch to 1300 g/inch. The cohesion herein means a force required for causing a cohesive failure for the adhesive layer in the 180° peel test.

As for the cohesion for the adhesive layer in the above range, it was obtained through experiments by the present inventors. That is, there were provided a plurality of laminate samples each comprising two different films and having an adhesive layer between the two films, obtained by subjecting two different films respectively applied with a given adhesive to lamination treatment using a lamination device comprising a pair of rubber rollers wherein two films were passed through between the two rubber rollers at a pressure of 2 Kg/30 cm. Each laminate sample was subjected to the 180° peel test using a tension testing machine wherein one of the films was peeled from the other film at room temperature and under conditions of 180° for the peel angle and 3 cm/sec for the peel rate, wherein a force required to causing a cohesive failure for the adhesive layer between the two films was obtained for each laminate sample. The cohesion in the above range was obtained based on the results thus obtained. As a result of further experiments by the present inventors, it was found that when the cohesion exceeds 1500 g/inch, there is a tendency that at the time of superposing the adhesive layer on the print-bearing surface of the object (the printing paper), an air bubble is liable to occur in a laminated portion to result in reducing the quality of a print product obtained; and when the cohesion is less than 500 g/inch, at the time of storing the pressure-sensitive protective covering material, the adhesive of the adhesive layer is liable to migrate and release from the pressure-sensitive protective covering material.

The hindered amine series light stabilizer contained in the adhesive layer functions as a plasticizer for the adhesive of the adhesive layer. Therefore, it is desirable for the adhesive layer to contain a crosslinking agent. The amount of the crosslinking agent contained in the adhesive layer should be determined with a due case so that the peel force of the first substrate against the adhesive layer is ensured to be in the foregoing range and the adhesive layer maintains a desirable strength over a long period of time. Particularly, the amount of the crosslinking agent contained in the adhesive layer is made to be about 1.3 times the stoichiometric amount thereof required to crosslink all the functional groups intended to crosslink so that the adhesive of the adhesive layer is sufficiently crosslinked. By this, even in the case where the hindered amine series light stabilizer is contained in the adhesive layer, the adhesive layer is ensured to have a desirable cohesion in the above range while maintaining a desirable adhesion property.

The acrylic adhesive is desired to comprise an acrylic monomer selected from the group consisting of alkyl ester monomers and alkoxyalkyl ester monomers.

Specific examples of such alkyl ester monomer include methyl acrylate, ethyl acrylate, propyl acrylate, isopropyl acrylate, isobutyl acrylate, 2-methylbutyl acrylate, 2-ethylbutyl acrylate, 3-methylbutyl acrylate, 1,3-dimethylbutyl acrylate, pentyl acrylate, 3-pentyl acrylate, hexyl acrylate, 2-ethylhexyl acrylate, heptyl acrylate, 2-heptyl acrylate, octyl acrylate, 2-octyl acrylate, and nonyl acrylate. Specific examples of such alkoxyalkyl ester monomer are 2-ethoxyethyl acrylate, 3-ethoxypropyl acrylate, 2-ethoxybutyl acrylate, 3-methoxybutyl acrylate, 2-ethoxyethyl acrylate, and 3-methoxypropyl acrylate. Of these monomers, it is desired to selectively use relevant acrylic monomers capable of providing homopolymers having a glass transition temperature of −3° C. to −75° C.

In order to make the adhesive layer to have a desired cohesion in the above range, there can be employed any of the following four manners.

A first manner is to use a copolymerization component such as methacrylate monomer, vinyl acetate, styrene, acrylonitrile, acrylamide, or methacrylamide.

A second manner is to conduct crosslinking using N-methylolacrylamide, N-methylolmethacrylate, diacetonacrylamide, or butoxymethylacrylamide.

A third manner is to copolymerize a hydroxyl group-containing monomer, followed by crosslinking with the use of a polyvalent isocyanate compound.

As the hydroxyl group-containing monomer usable in this manner, there can be mentioned 2-hydroxyethylacrylate, 2-hydroxypropylacrylate, hydroxybutylacrylate, 2-hydroxyethylmethacrylate, 2-hydroxypropylmetacrylate, hydroxybutylmethacrylate, acrylic esters of polyols, methacrylic esters of polyols, acrylic ethylcarbitol, acrylic methyltriglycol, 2-hydroxyethylacryloyl phosphate, propoxyethyl acrylate, and dimethylaminoethyl acrylate.

As the polyvalent isocyanate compound, there can be mentioned tolylenediisocyanate, hexamethylenediisocyanate, diphenylmethanediisocyanate, isophorondiisocyanate, xylenediisocyanate, bis(isocyanatomethyl)cyclohexane, dicyclohexylmethanediisocyanate, lysinediisocyanate, trimethylhexamethylenediisocyanate, hexamethylenediisocynate adduct, modified urethane, modified allophanate, modified biuret, modified isocyanurate, and urethane prepolymers (olygomer compounds having both ends each comprising an isocyanate group).

A fourth manner is to introducing a carboxyly group into an acrylic resin, followed by crosslinking with an epoxy resin.

The crosslinking manner upon forming the adhesive layer in the present invention typically comprises incorporating a crosslinkable group such as hydroxyl group or carboxyl group in an amount of at least 3% or preferably, 5% to 7%, based on a copolymerization molar ratio, into a high molecular chain. In the case of a conventional adhesive in which no light stabilizing agent is used, a sufficient cohesion can be attained by the introduction of a crosslinkable group in an amount of about 1%, even in the case where a monomer having a high cohesiveness is used.

Description will be made of the hindered amine series light stabilizer contained in the adhesive layer of the pressure-sensitive transferring material according to the present invention.

In the present invention, the hindered amine series light stabilizer is used in order to desirably stabilize a print formed of a dye.

The hindered amine series light stabilizer usable in the present invention can include commercially available hindered amine series light stabilizers having a property of dispersing within a region where it can react with a dye molecule and deactivate an active species.

Preferable specific examples of such hindered amine series light stabilizer include TINUVIN 292, TINUVIN 123, and TINUVIN 144 (trademarks, produced by Japan Ciba-Geigy Company).

The adhesive layer containing such light stabilizer in the present invention has a property of allowing the light stabilizer to disperse, resulting in attaining an improved light resistance for a print formed of a dye on an object.

Particularly, when the protective covering material of the present invention is laminated on an object having a print formed of a dye thereon so as to cover said print, the hindered amine series light stabilizer contained in the adhesive layer is considered to behave such that as time goes by, it gradually disperses to contact with the dye of the print on the object wherein it becomes to be in a molecular state approximate to that of the dye of the print, resulting in providing an energy dispersion effect of preventing the print from being deteriorated by light.

In the present invention, it is possible to replace the hindered amine series light stabilizer by other appropriate light stabilizers. However, in view of attaining a good compatibility with the adhesive resin used for the formation of the adhesive layer, the hindered amine series light stabilizer is the most desirable.

As for the amount of the hindered amine series stabilizer contained in the adhesive layer, it should be properly determined within a range wherein the adhesive layer is ensured to have a desired cohesion and release property. However, in general, it is desired to be preferably in the range of 0.3 $g/m^2$ to 3.2 $g/m^2$ or more preferably, in the range of 1.0 $g/m^2$ to 2.5 $g/m^2$.

Solid Resin Layer

As above described, the solid resin layer comprises a transparent resin layer containing a UV absorber which has a glass transition temperature of 50° C. or above.

In the present invention, when the protective covering material is laminated on an object having a print formed of a dye thereon, since the second flexible substrate is peeled at a final stage, the solid resin layer eventually becomes an outermost surface layer. Because of this, the solid resin layer is required to be transparent, rigid, and highly resistant to chemicals and to have a good form-retaining property. Further, the solid resin layer is required to have such a property that the second flexible substrate can be readily and effectively peeled from the solid resin layer.

The solid resin layer in the present invention which satisfies these conditions comprises a transparent thermosetting resin having a glass transition temperature of 50° C. or above, preferably of 80° C. or above.

The purpose of making the solid resin layer such that it allows the second flexible substrate to be readily and effectively peeled therefrom can be attained by a manner of crosslinking the solid resin layer or a manner of making the solid resin layer to have an appropriate release property. Other than this manner, this purpose can be also attained by making the first flexible substrate to have an appropriate release property.

In any case, as above described, it is required to design the solid resin layer such that it allows the second flexible substrate to be readily and effectively peeled therefrom, wherein the peel force required upon peeling the second flexible substrate from the solid resin layer is necessary to be greater than that required upon peeling the adhesive layer from the first flexible substrate.

The solid resin layer is formed using an appropriate thermosetting resin so that the above conditions required therefor are satisfied. Such resin can include polycarbonate resins; polystyrenes or styrene derivatives such as styrene, 2-hydroxymethylstyrene, 2-isobutylcarbonylstyrene, 4-isobutylcarbonylstyrene, and 2-methylstyrene; and acrylic thermosetting resins such as methylmethacrylate, t-butylacrylate, t-butylmethacrylate, 2-t-butylphenylacrylate, 4-t-phenylacrylate, 2-naphthylacrylate, t-butylmethacrylate, isobonylmethacrylate, trimethylsilylmethacrylate, phenylmethacrylate, and copolymers of these compounds.

As above described, as the solid resin layer serves as the surface protective layer at the final stage, the solid resin layer is necessary to be designed such that it excels in heat resistance, form-retaining property, and resistance to chemicals. The solid resin layer is therefore desired to be formed using an appropriate thermosetting resin selected from those above mentioned which satisfies these conditions and has an excellent crosslinking structure. Such resin can include those selected from the foregoing thermosetting resins which have a property of providing a desirable crosslinking structure in the resulting solid resin layer and those selected from the foregoing thermosetting resins which are reactive with a crosslinking agent.

Specifically, the resin by which the solid resin layer is constituted is desired to be a resin selected from the foregoing thermosetting resins which can provide a crosslinked structure at a temperature of less than 120° C. and which can cause the formation of a highly heat resistant film.

Specific examples of such thermosetting resin include acrylic resins having, as their copolymerization components, condensing monomers such as N-alkylacrylamides, e.g., N-methylolacrylamide, N-butoxymethylacrylamide or the like; and acrylic resins comprising condensing monomers such as those in which vinylmethoxysilanes are copolymerized. Of these, acrylic resins having a self-crosslinking silanol group are the most desirable because they excel in transparency and release property.

Specific examples of the thermosetting resin which is reactive with a crosslinking agent include acrylpolyols, polyesterpolyols, and polyetherpolyols, which are reactive with a crosslinking agent such as isocyanate, epoxy resin, or the like.

Description will be made of the UV absorber contained in the solid resin layer.

The UV absorber is contained in the solid resin layer for the purpose of preventing not only the solid resin layer but also a print formed of a dye to be protected from being deteriorated by light. The UV absorber usable in the present invention can include benzophenone series UV absorbers, benzotriazole series UV absorbers, acetanilide series UV absorbers, cyanoacrylate series UV absorbers, and triazine series UV absorbers. In a preferred embodiment, of these UV absorbers, those which excel in compatibility with the constituent resin of the sold resin layer, long time persistence, and stability are selectively used. Specific preferable examples are commercially available acetanilide series UV absorbers such as Sanduvor UVS powder and Sanduvor 3206 Liquid (trademark names, produced by Sando Kabushiki Kaisha); and commercially available benzotrizole series UV absorbers such as TINUVIN 328, TINUVIN 900, TINUVIN 1130, and TINUVIN 384 (trademark names, produced by Japan Ciba-Geigy Company), and Sanduvor 3041 Dispersion (trademark name, produced by Sando Kabushiki Kaisha).

As for the amount of the UV absorber contained in the solid resin layer, it should be properly determined while having a due regard so that the resulting solid resin layer has a desirable hardness and a desirable UV absorbing property. However, in general, it is preferably in the range of 0.5 $g/m^2$ to 3.0 $g/m^2$ or more preferably, in the range of 1.0 $g/m^2$ to 2.5 $g/m^2$. It should be noted that when the amount of the UV absorber is less than 0.5 $g/m^2$, there cannot be attained a sufficient light resistance for a print formed of a dye to be protected, and when it exceeds 3.0 $g/m^2$, problems are liable to entail in that the effect of providing a light resistance for the print is not further facilitated depending on an increase in the amount of the UV absorber, and a negative influence is effected for the photopolymerization, resulting in making the UV absorber to bleed at the surface of the solid resin layer in the worst case.

Second Flexible Substrate

As previously described, the second flexible substrate is required to have a property such that when the first flexible substrate of the protective covering material is peeled from the adhesive layer upon laminating the protective covering material on an object having a print formed of a dye thereon so as to cover the print, it is maintained in a state of being fixed to the solid resin layer, and after having completed the lamination, it can be surely peeled from the surface of the solid resin layer.

The second flexible substrate is designed so as to satisfy this condition. Particularly, the second flexible substrate is designed to have a specific peel force against the solid resin layer so that the second flexible substrate can be surely stripped from the solid resin layer at the final stage. Specifically, the second flexible substrate is designed to have a peel force preferably in the range of 120 g/inch to 400 g/inch or more preferably, in the range of 150 g/inch to 300 g/inch against the solid resin layer.

When the peel force of the second flexible substrate exceeds 400 g/inch, problems entail in that a cohesive failure is liable to result at the surface of the solid resin layer, resulting in deteriorating the surface gloss of the solid resin layer and also in causing a removal for the solid resin layer laminated on the print-bearing surface.

In any case, the peel force of the second flexible substrate is desired to be made greater by 100 g/inch over that of the first flexible substrate.

As for the peel force for the second flexible substrate in the above range, it was obtained through experiments by the present inventors. That is, a plurality of composites each comprising a given flexible substrate and a given solid resin layer disposed on said flexible substrate were provided. Each composite was bonded on a surface of a glass plate through the solid resin layer to thereby obtain a plurality of stacked samples. Each stacked sample was subjected to the 180° peel test using a tension testing machine wherein the flexible substrate was peeled from the solid resin layer at room temperature and under conditions of 180° for the peel angle and 3 cm/sec for the peel rate, wherein a force required to peel the flexible substrate from the solid resin layer was obtained for each stacked sample. The peel force in the above range was obtained based on the results thus obtained.

Specific examples of the constituent material of the second flexible substrate which satisfies the condition of the above peel force include films of polyethylene, films of polypropylene, films of vinylidene chloride-vinyl chloride copolymer, films of polyethylene terephthalate, and films comprising composites of these films.

In order to attain a specific peel force in the above range for any of the above described films, there can be employed a manner of subjecting the surface of the film to a mat processing treatment or a manner of subjecting the surface of the film to corona treatment or flame treatment.

In the present invention, each constituent of the pressure-sensitive transferring protective covering material is desired to have an appropriate thickness such that the first flexible substrate is of a thickness in the range of 25 μm to 80 μm, the adhesive layer is of a thickness in the range of 2 μm to 10 μm, the solid resin layer is of a thickness in the range of 3 μm to 25 μm, and the second flexible substrate is of a thickness in the range of 50 μm to 150 μm.

The pressure-sensitive transferring protective covering material according to the present invention may be produced by a conventional stacked body-producing manner.

Specifically, for instance, the pressure-sensitive transferring protective covering material according to the present invention may be produced in accordance with any of the following two manners.

A first manner comprises the steps of applying a coating material for the formation of the solid resin layer on a surface of a given flexible substrate as the second flexible substrate, followed by drying, wherein if necessary, the coat formed on the second flexible substrate is subjected to a hardening treatment, to thereby form the solid resin layer on the second flexible substrate; applying a coating material for the formation of the adhesive layer on the surface of the solid resin layer, followed by drying, wherein if necessary, the coat formed on the solid resin layer is subjected to a hardening treatment, to thereby form the adhesive layer on the solid resin layer; and finally, laminating a given flexible substrate as the first flexible substrate to the surface of the adhesive layer.

A second manner comprises the steps of providing a stacked body comprising a given solid resin layer as the solid resin layer formed on a surface of a given flexible substrate as the second flexible substrate; applying a coating material for the formation of the adhesive layer on a surface of a given flexible substrate as the first flexible substrate, followed by drying, wherein if necessary, the coat formed on the first flexible substrate is subjected to a hardening treatment, to thereby obtain another stacked body comprising the adhesive layer formed on the first flexible substrate; and finally, superposing the surface of the solid resin layer of the former stacked body to the surface of the adhesive layer of the latter stacked body.

In the following, the present invention will be described in more detail with reference to examples. It should be understood that these examples are only for the illustrative purposes but are not intended to restrict the scope of the present invention to these examples.

EXAMPLE 1

There was prepared a pressure-sensitive transferring material of the configuration shown in FIG. 1 in the following manner.

Formation of a adhesive layer 2 on a first flexible substrate 1:

There was provided a 50 μm thick polyethylene trephthalate film having a surface applied with a silicone resin at a thickness of 1 μm as the first flexible substrate.

Then, for the formation of the adhesive layer, there was provided a coating composition obtained by well mixing 200 parts by weight of a toluene solution containing 20 wt. % of a copolymer comprising 2-ethylhexylacrylate, 2-hydroxylethylacrylate and acrylonitrile (with a copolymerization ratio of 80:10:10 in terms of weight ratio and a weight average molecular weight of 670,000), one part by weight of a modified biuret material of hexamethylenediisocyanate (trademark name: SUMIDUR N-3200-90MX, produced by Sumitomo Bayer Urethane Company), and 10 parts by weight of a light stabilizer TINUVIN 123 (trademark name, produced by Japan Ciba-Geigy Company).

Onto the silicone resin-coated surface of the first flexible substrate, the above coating composition was applied in an amount to provide a thickness of 3 μm when dried, by means of a wire bar coater, followed by drying at 80° C. for 10 minutes and then to aging treatment at 50° C. for 24 hours, whereby a 3 μm thick adhesive layer was formed on the first flexible substrate. Herein, the amount of the hindered amine series light stabilizer contained in the adhesive layer was 0.6 $g/m^2$.

The resultant herein will be hereinafter referred to as a first stacked body.

Formation of a solid resin layer 3 on a second flexible substrate 4:

There was provided a 25 μm thick polyethylene terephthalate film having a surface applied with mat processing as the second flexible substrate.

Then, for the formation of the solid resin layer, there was provided a coating composition by well mixing 200 parts by weight of a toluene solution containing 20 wt. % of a copolymer comprising methylmethacrylate and vinylmethoxysilane (with a copolymerization ratio of 95:5 in terms of weight ratio and a weight average molecular weight of 200,000), 0.3 part by weight of p-toluenesulfonic acid and 15 parts by weight of a UV absorber TINUVIN 384 (trademark name, produced by Japan Ciba-Geigy Company).

Onto the mat-processed surface of the second flexible substrate, the above coating composition was applied in an amount to provide a thickness of 7 μm when dried, by means of a wire bar coater, followed by drying at 100° C. for 5 minutes, whereby a 7 μm thick solid resin layer was formed on the second flexible substrate. Herein, the amount of the UV absorber contained in the solid resin layer was 1.9 g/m$^2$.

The resultant herein will be hereinafter referred to as a second stacked body.

Formation of a pressure-sensitive transferring protective covering material:

The surface of the adhesive layer of the first stacked body was superposed onto the surface of the solid resin layer of the second stacked body to obtain a pressure-sensitive transferring protective covering material. In this way, there were prepared a plurality of pressure-sensitive transferring protective covering materials.

Evaluation

1. Using one of the protective covering materials obtained in the above, the peel force of the first flexible substrate against the adhesive layer and the peel force of the second flexible substrate against the solid resin layer were examined by way of the 180° peel test. As a result, it was found that the former is 35 g/inch and the latter is 150 g/inch.

2. The cohesion of the adhesive layer of the protective covering material was examined in a manner of providing two 25 μm thick polyethylene terephthalate films each having a surface applied with a saturated polyester resin for the purpose of having an increased adhesion, forming an adhesive layer on the surface of each of the two films by repeating the foregoing procedures of forming the adhesive layer, superposing the surface of the adhesive layer of one of the two films onto the surface of the adhesive layer of the other film to obtain a stacked body, and subjecting the stacked body to the 180° peel test. As a result, the adhesive layer of the protective covering material was found to have a cohesion of 850 g/inch.

3. Using the remaining protective covering materials, evaluation was conducted with respect to its effect of preventing a print formed of a dye on an object from being deteriorated by light in the following manner.

That is, there were firstly provided a plurality of commercially available coated papers for color ink jet printing, comprising a white silica pigment and containing a cationic high molecular water-proof material.

Using a commercially available bubble jet printer BJC-600J (trademark name, produced by Canon Kabushiki Kaisha), there were spacedly formed, on each of the coated papers, test patches each comprising one of seven colors, i.e., yellow, cyan, magenta, black, green, blue and red using an azo series black direct dye, an azo series yellow direct dye, an azo series magenta direct dye, and a water-soluble copper phthalocyanine cyan dye, to obtain a plurality of print samples.

(1) Using some of the print samples on the test patches-bearing surface of each print sample, the protective covering material was laminated through the adhesive layer while peeling the first flexible substrate at a speed of 0.5 m/minute and at room temperature, wherein the test patches of the print sample were covered by the adhesive layer, and thereafter, the second flexible substrate was peeled, to thereby obtain a plurality of print products. The resultant print products were dedicated for the evaluation.

(2) For the comparison purpose, the remaining print samples were applied with no such covering treatment as in the above (1). These were made to be comparative print samples of Comparative Example 1. Each comparative print sample was dedicated for the evaluation.

(3) The print products and the comparative print samples were evaluated in a manner of storing in the natural environment for a couple of days and thereafter conducting an accelerated light resistance test for 330 hours using an Atlas Xenon Fade-O-Meter (produced by Atlas Company), during which sampling was conducted to obtain samples having had light irradiation for 83 hours and for 200 hours. As for the print products and the comparative print samples thus endured, measurement was conducted with respect to their color difference (L*a*b*, CIE 1976) in order to examine their situation for light resistance.

The evaluated results as for the print products in Example 1 are shown in Table 1.

The evaluated results for the comparative samples of Comparative Example 1 are shown in Table 2.

The term "ΔE" in each of Tables 1 and 2 indicates a distance between each adjacent color in the L*a*b* color space. Herein, it is meant that the greater the value of the ΔE is, the greater the change between the hue of one color and that of the other color. Particularly, in the case of the present invention, the light resistance effect of the protective covering material can be distinguished based on the ΔE value, wherein the ΔE value which is large means that the protective covering material is poor in light resistance.

In the above, the position of the color in the L*a*b* color space was obtained by means of a commercially available high speed spectrophotometer (produced by Murakami Shikisai Gijutsu Kenkyusho Kabushiki Kaisha).

From the results shown in Tables 1 and 2, it was found that the protective covering material according to the present invention enables to markedly prevent a print formed of a dye from being deteriorated by light, wherein the print covered using the protective covering material is stably maintained in a desirable state without being deteriorated by light even upon storing over a long period of time under severe environmental condition.

EXAMPLE 2

There was prepared a pressure-sensitive transferring material of the configuration shown in FIG. 1 in the following manner.

Formation of an adhesive layer 2 on a first flexible substrate 1:

There was provided a 50 μm thick polyethylene trephthalate film having a surface applied with a silicone resin at a thickness of 1 μm as the first flexible substrate.

Then, for the formation of the adhesive layer, there was provided a coating composition obtained by well mixing 200 parts by weight of an ethylene glycol/toluene solution containing 25 wt. % of a copolymer comprising 2-ethylhexylacrylate, N-methylolacrylamide and acrylonitrile (with a copolymerization ratio of 85:10:5 in terms of weight ratio and a weight average molecular weight of 300,000), 10 parts by weight of a light stabilizer TINUVIN 292 (trademark name, produced by Japan Ciba-Geigy Company), and 0.2 part by weight of p-toluenesulfonic acid.

Onto the silicone resin-coated surface of the first flexible substrate, the above coating composition was applied in an amount to provide a thickness of 6 μm when dried, by means of a wire bar coater, followed by drying at 80° C. for 10 minutes and then to aging treatment at 50° C. for 24 hours, whereby a 6 μm thick adhesive layer was formed on the first flexible substrate. Herein, the amount of the hindered amine series light stabilizer contained in the adhesive layer was 1.0 g/m$^2$.

The resultant herein will be hereinafter referred to as a first stacked body.

Formation of a solid resin layer 3 on a second flexible substrate 4:

There was provided a 25 μm thick polyethylene terephthalate film having a surface applied with mat processing as the second flexible substrate.

Then, for the formation of the solid resin layer, there was provided a coating composition by well mixing 200 parts by weight of a toluene solution containing 20 wt. % of a copolymer comprising methylmethacrylate, t-butylmethacrylate and vinylmethoxysilane (with a copolymerization ratio of 80:15:5 in terms of weight ratio and a weight average molecular weight of 170,000), 0.2 part by weight of p-toluenesulfonic acid and 15 parts by weight of a UV absorber TINUVIN 130 (trademark name, produced by Japan Ciba-Geigy Company).

Onto the mat-processed surface of the second flexible substrate, the above coating composition was applied in an amount to provide a thickness of 8 μm when dried, by means of a wire bar coater, followed by drying at 100° C. for 5 minutes, whereby a 8 μm thick solid resin layer was formed on the second flexible substrate. Herein, the amount of the UV absorber contained in the solid resin layer was 2.2 g/m$^2$.

The resultant herein will be hereinafter referred to as a second stacked body.

Formation of a pressure-sensitive transferring protective covering material:

The surface of the adhesive layer of the first stacked body was superposed onto the surface of the solid resin layer of the second stacked body to obtain a pressure-sensitive transferring protective covering material. In this way, there were prepared a plurality of pressure-sensitive transferring protective covering materials.

Evaluation

1. Using one of the protective covering materials obtained in the above, the peel force of the first flexible substrate against the adhesive layer and the peel force of the second flexible substrate against the solid resin layer were examined by way of the 180° peel test. As a result, it was found that the former is 40 g/inch and the latter is 150 g/inch.

2. The cohesion of the adhesive layer of the protective covering material was examined in the same manner as in Example 1. As a result, the adhesive layer of the protective covering material was found to have a cohesion of 1050 g/inch.

3. Using the remaining protective covering materials, evaluation was conducted with respect to its effect of preventing a print formed of a dye on an object from being deteriorated by light in the same manner as in Example 1.

The evaluated results as for the print products are shown in Table 3.

From the evaluated results shown in Table 3 and while referring to the evaluated results of Comparative Example 1 shown in Table 2, it was found that the protective covering material according to the present invention enables to markedly prevent a print formed of a dye from being deteriorated by light, wherein the print covered using the protective covering material is stably maintained in a desirable state without being deteriorated by light even upon storing over a long period of time under severe environmental condition.

EXAMPLE 3

There was prepared a pressure-sensitive transferring material of the configuration shown in FIG. 1 in the following manner.

Formation of a solid resin layer 3 on a second flexible substrate 4:

There was provided a 25 μm thick polyethylene terephthalate film having a surface applied with mat processing as the second flexible substrate.

Then, for the formation of the solid resin layer, there was provided a coating composition by well mixing 200 parts by weight of a toluene solution containing 20 wt. % of a copolymer comprising styrene, ethylmethacrylate, 2-hydroxymethacrylate and acrylic acid (with a copolymerization ratio of 50:35:10:5 in terms of weight ratio and a weight average molecular weight of 5000), one part by weight of a modified biuret material of hexamethylenediisocyanate (trademark name: SUMIDUR N-3200-90MX, produced by Sumitomo Bayer Urethane Company), and 15 parts by weight of a UV absorber TINUVIN 328 (trademark name, produced by Japan Ciba-Geigy Company).

Onto the mat-processed surface of the second flexible substrate, the above coating composition was applied in an amount to provide a thickness of 7 μm when dried, by means of a wire bar coater, followed by drying at 100° C. for 5 minutes, whereby a 7 μm thick solid resin layer was formed on the second flexible substrate. Herein, the amount of the UV absorber contained in the solid resin layer was 1.9 g/m$^2$.

Formation of an adhesive layer 2 on the solid resin layer formed on the second flexible substrate obtained in the above:

For the formation of the adhesive layer, there was provided a coating composition obtained by well mixing 200 parts by weight of a methyl ethyl ketone solution containing 20 wt. % of a copolymer comprising polyvinyl methyl ether and N-butoxymethylacrylamide (with a copolymerization ratio of 90:10 in terms of weight ratio and a weight average molecular weight of 200,000), 0.4 part by weight of p-toluenesulfonic acid, and 10 parts by weight of a light stabilizer TINUVIN 144 (trademark name, produced by Japan Ciba-Geigy Company).

Onto the surface of the solid resin layer formed on the second flexible substrate, the above coating composition was applied in an amount to provide a thickness of 2 μm when dried, by means of a wire bar coater, followed by drying at 75° C. for 5 minutes and then to an aging treatment at 50° C. for 24 hours, whereby a 2 μm thick adhesive layer was formed on the solid resin layer on the second flexible substrate to obtain a stacked body. Herein, the amount of the hindered amine series light stabilizer contained in the adhesive layer was 0.4 g/m$^2$.

Formation of a pressure-sensitive transferring protective covering material:

There was provided a 50 μm thick biaxially-oriented polyethylene film as the first flexible substrate 1.

The first flexible substrate was laminated to the surface of the adhesive surface of the stacked body obtained in the above using a heating roller to obtain a pressure-sensitive transferring protective covering material. In this way, there were prepared a plurality of pressure-sensitive transferring protective covering materials.

Evaluation

1. Using one of the protective covering materials obtained in the above, the peel force of the first flexible substrate against the adhesive layer and the peel force of the second flexible substrate against the solid resin layer were examined by way of the 180° peel test. As a result, it was found that the former is 25 g/inch and the latter is 180 g/inch.

2. The cohesion of the adhesive layer of the protective covering material was examined in the same manner as in Example 1.

As a result, the adhesive layer of the protective covering material was found to have a cohesion of 730 g/inch.

3. Using the remaining protective covering materials, evaluation was conducted with respect to its effect of preventing a print formed of a dye on an object from being deteriorated by light in the same manner as in Example 1.

In addition, as well as in Example 1, for the comparison purpose, print samples applied with no covering treatment were provided as comparative print samples of Comparative Example 2 and they were dedicated for the evaluation as in Example 1.

The evaluated results as for the print products in Example 3 are shown in Table 4.

The evaluated results for the comparative samples of Comparative Example 2 are shown in Table 5.

From the evaluated results shown in Tables 4 and 5, it was found that the protective covering material according to the present invention enables to markedly prevent a print formed of a dye from being deteriorated by light, wherein the print covered using the protective covering material is stably maintained in a desirable state without being deteriorated by light even upon storing over a long period of time under severe environmental condition.

EXAMPLE 4

There was prepared a pressure-sensitive transferring material of the configuration shown in FIG. 1 in the following manner.

Formation of an adhesive layer 2 on a first flexible substrate 1:

There was provided a 50 μm thick polyethylene trephthalate film having a surface applied with a silicone resin at a thickness of 1 μm as the first flexible substrate.

Then, there was provided the same coating composition for the formation of the adhesive layer as used in Example 1

Onto the silicone resin-coated surface of the first flexible substrate, the coating composition was applied in an amount to provide a thickness of 16 μm when dried, by means of a wire bar coater, followed by drying at 80° C. for 10 minutes and then to aging treatment at 50° C. for 24 hours, whereby a 16 μm thick adhesive layer was formed on the first flexible substrate. Herein, the amount of the hindered amine series light stabilizer contained in the adhesive layer was 3.2 g/m$^2$.

The resultant herein will be hereinafter referred to as a first stacked body.

Formation of a solid resin layer 3 on a second flexible substrate 4:

There was provided a 25 μm thick polyethylene terephthalate film having a surface applied with mat processing as the second flexible substrate.

Then, there was provided the same coating composition for the formation of the solid resin layer as used in Example 1.

Onto the mat-processed surface of the second flexible substrate, the coating composition was applied in an amount to provide a thickness of 11 μm when dried, by means of a wire bar coater, followed by drying at 100° C. for 5 minutes, whereby a 11 μm thick solid resin layer was formed on the second flexible substrate. Herein, the amount of the UV absorber contained in the solid resin layer was 3 g/m$^2$.

The resultant herein will be hereinafter referred to as a second stacked body.

Formation of a pressure-sensitive transferring protective covering material:

The surface of the adhesive layer of the first stacked body was superposed onto the surface of the solid resin layer of the second stacked body to obtain a pressure-sensitive transferring protective covering material. In this way, there were prepared a plurality of pressure-sensitive transferring protective covering materials.

Evaluation

1. Using one of the protective covering materials obtained in the above, the peel force of the first flexible substrate against the adhesive layer and the peel force of the second flexible substrate against the solid resin layer were examined by way of the 180° peel test. As a result, it was found that the former is 80 g/inch and the latter is 280 g/inch.

2. The cohesion of the adhesive layer of the protective covering material was examined in the same manner as in Example 1. As a result, the adhesive layer of the protective covering material was found to have a cohesion of 1280 g/inch.

3. Using the remaining protective covering materials, evaluation was conducted with respect to its effect of preventing a print formed of a dye on an object from being deteriorated by light in the same manner as in Example 1.

Particularly, there were prepared a plurality print samples. As for the print samples, on the test patches-bearing surface of each print sample, the protective covering material was laminated through the adhesive layer while peeling the first flexible substrate at a speed of 2 m/minute and at room temperature, wherein the test patches of the print sample were covered by the adhesive layer, and thereafter, the second flexible substrate was stripped, to thereby obtain a plurality of print products.

In any case, the removal of the second flexible substrate could be smoothly conducted. And no air bubble was found at the interface portion of any of the print products. Further, all the pint products were found to have a highly smooth surface.

4. Some of the print products obtained in the above 3 were dedicated for the light resistance test under real environments in the following manner. That is, each print product was fixed to a surface of a wood plate in a waterproof state, followed by maintaining in outdoors for 3 months while preventing it from directly suffering from rain falls.

The hue of each endured print product was examined while comparing with that of the print product not having subjected to the light resistance test. As a result, each endured print product was found to have a clear hue with no substantial discoloration.

Further, as for the endured print products, their OD survival rates were evaluated in the following manner. That is, as for each of the endured print products, its reflection density was measured. Of the resultant reflection density values, there was obtained a mean reflection density value (a). Separately, each of the non-endured print products was maintained in a dark environment and its reflection density was measured. Of the resultant reflection density values, there was obtained a mean reflection density value (b). And a percentage of the mean reflection density value (a) to the means reflection density value was calculated. The results obtained are shown in Table 6.

EXAMPLE 5

There was prepared a pressure-sensitive transferring material of the configuration shown in FIG. 1 in the following manner.

Formation of an adhesive layer 2 on a first flexible substrate 1:

There was provided a 50 μm thick polyethylene trephthalate film having a surface applied with a silicone resin at a thickness of 1 μm as the first flexible substrate.

Then, there was provided the same coating composition for the formation of the adhesive layer as used in Example 2.

Onto the silicone resin-coated surface of the first flexible substrate, the coating composition was applied in an amount to provide a thickness of 7 μm when dried, by means of a wire bar coater, followed by drying at 80° C. for 10 minutes and then to aging treatment at 50° C. for 24 hours, whereby a 7 μm thick adhesive layer was formed on the first flexible substrate. Herein, the amount of the hindered amine series light stabilizer contained in the adhesive layer was 1.16 $g/m^2$.

The resultant herein will be hereinafter referred to as a first stacked body.

Formation of a solid resin layer 3 on a second flexible substrate 4:

There was provided a 25 μm thick polyethylene terephthalate film having a surface applied with mat processing as the second flexible substrate.

Then, there was provided the same coating composition for the formation of the solid resin layer as used in Example 2.

Onto the mat-processed surface of the second flexible substrate, the coating composition was applied in an amount to provide a thickness of 10 μm when dried, by means of a wire bar coater, followed by drying at 100° C. for 5 minutes, whereby a 10 μm thick solid resin layer was formed on the second flexible substrate. Herein, the amount of the UV absorber contained in the solid resin layer was 2.7 $g/m^2$.

The resultant herein will be hereinafter referred to as a second stacked body.

Formation of a pressure-sensitive transferring protective covering material:

The surface of the adhesive layer of the first stacked body was superposed onto the surface of the solid resin layer of the second stacked body to obtain a pressure-sensitive transferring protective covering material. In this way, there were prepared a plurality of pressure-sensitive transferring protective covering materials.

Evaluation

1. Using one of the protective covering materials obtained in the above, the peel force of the first flexible substrate against the adhesive layer and the peel force of the second flexible substrate against the solid resin layer were examined by way of the 180° peel test. As a result, it was found that the former is 65 g/inch and the latter is 200 g/inch.

2. The cohesion of the adhesive layer of the protective covering material was examined in the same manner as in Example 1. As a result, the adhesive layer of the protective covering material was found to have a cohesion of 1200 g/inch.

3. Using the remaining protective covering materials, evaluation was conducted with respect to its effect of preventing a print formed of a dye on an object from being deteriorated by light in the same manner as in Example 1.

Particularly, there were prepared a plurality of print samples. As for the print samples, on the test patches-bearing surface of each print sample, the protective covering material was laminated through the adhesive layer while peeling the first flexible substrate at a speed of 1 m/minute and at room temperature, wherein the test patches of the print sample were covered by the adhesive layer, and thereafter, the second flexible substrate was stripped, to thereby obtain a plurality of print products.

In any case, the removal of the second flexible substrate could be smoothly conducted and no air bubble was found at the interface portion of any of the print products. Further, all the print products were found to have a highly smooth surface.

4. Some of the print products obtained in the above 3 were dedicated for the light resistance test under real environments in the following manner. That is, each print product was fixed to a surface of a wood plate in a waterproof state, followed by maintaining in outdoors for 3 months while preventing it from directly suffering from rain falls.

The hue of each endured print product was examined while comparing with that of the print product not having subjected to the light resistance test. As a result, each endured print product was found to have a clear hue with no substantial discoloration.

Further, as for the endured print products, their OD survival rates were evaluated in the following manner. That is, as for each of the endured print products, its reflection density was measured. Of the resultant reflection density values, there was obtained a mean reflection density value (a). Separately, each of the non-endured print products was maintained in a dark environment and its reflection density was measured. Of the resultant reflection density values, there was obtained a mean reflection density value (b) and a percentage of the mean reflection density value (a) to the means reflection density value was calculated. The results obtained are shown in Table 6.

Comparative Example 3

There was prepared a pressure-sensitive transferring material of the configuration shown in FIG. 1 in the following manner.

Formation of an adhesive layer 2 on a first flexible substrate 1:

There was provided a 50 μm thick polyethylene trephthalate film having a surface applied with a silicone resin at a thickness of 1 μm as the first flexible substrate.

Then, for the formation of the adhesive layer, there was provided a coating composition obtained by well mixing 230 parts by weight of an ethylene glycol monomethyl ether/toluene solution containing 20 wt. % of a copolymer comprising 2-ethylhexylacrylate, N-methylolacrylamide and acrylonitrile (with a copolymerization ratio of 70:10:20 in terms of weight ratio and a weight average molecular weight of 450,000), 10 parts by weight of a light stabilizer TINUVIN 292 (trademark name, produced by Japan Ciba-Geigy Company) and 0.2 part by weight of p-toluenesulfonic acid.

Onto the silicone resin-coated surface of the first flexible substrate, the above coating composition was applied in an amount to provide a thickness of 5 μm when dried, by means of a wire bar coater, followed by drying at 100° C. for 10 minutes, whereby a 5 μm thick adhesive layer was formed on the first flexible substrate. Herein, the amount of the light stabilizer contained in the adhesive layer was 0.9 g/m$^2$.

The resultant herein will be hereinafter referred to as a first stacked body.

Formation of a solid resin layer 3 on a second flexible substrate 4:

There was provided a 25 μm thick polyethylene terephthalate film having a surface applied with mat processing as the second flexible substrate.

Then, for the formation of the solid resin layer, there was provided a coating composition by well mixing 200 parts by weight of a toluene solution containing 20 wt. % of a copolymer comprising methylmethacrylate, t-butylacrylate and vinylmethoxysilane (with a copolymerization ratio of 80:15:5 in terms of weight ratio and a weight average molecular weight of 170,000), 0.2 part by weight of p-toluenesulfonic acid and 15 parts by weight of a UV absorber TINUVIN 130 (trademark name, produced by Japan Ciba-Geigy Company).

Onto the mat-processed surface of the second flexible substrate, the above coating composition was applied in an amount to provide a thickness of 15 μm when dried, by means of a wire bar coater, followed by drying at 100° C. for 5 minutes, whereby a 15 μm thick solid resin layer was formed on the second flexible substrate. Herein, the amount of the UV absorber contained in the solid resin layer was 2.2 g/m$^2$.

The resultant herein will be hereinafter referred to as a second stacked body.

Formation of a pressure-sensitive transferring protective covering material:

The surface of the adhesive layer of the first stacked body was superposed onto the surface of the solid resin layer of the second stacked body to obtain a pressure-sensitive transferring protective covering material. In this way, there were prepared a plurality of pressure-sensitive transferring protective covering materials.

Evaluation

1. The cohesion of the adhesive layer of the protective covering material was examined in the same manner as in Example 1. As a result, the adhesive layer of the protective covering material was found to have a cohesion of 1700 g/inch.

2. As for the protective covering materials, evaluation was conducted with respect to its effect of preventing a print formed of a dye on an object from being deteriorated by light in the same manner as in Example 1.

Particularly, there were prepared a plurality of print samples. As for the print samples, on the test patches-bearing surface of each print sample, the protective covering material was laminated through the adhesive layer while peeling the first flexible substrate at a speed of 1 m/minute and at room temperature, wherein the test patches of the print sample were covered by the adhesive layer, and thereafter, the second flexible substrate was peeled. However, the second flexible substrate was peeled together with the laminate comprising the solid resin layer and adhesive layer because the adhesive layer was poor in adhesion. In view of this, the above lamination process was conducted while raising the room temperature to 70° C. However, any of the resultant print products was found to have a surface poor in gloss and had a number of minute air bubbles spacedly dotted thereon.

TABLE 1

| | change in Δ E value | | | |
|---|---|---|---|---|
| Example 1 | initial stage | after 83 hours | after 200 hours | after 300 hours |
| black | 0 | 4.7 | 8.2 | 9.3 |
| yellow | 0 | 5.3 | 9.2 | 10.0 |
| magenta | 0 | 5.6 | 12.3 | 16.8 |
| cyan | 0 | 4.5 | 8.1 | 8.8 |
| red | 0 | 5.6 | 9.9 | 11.9 |
| green | 0 | 1.7 | 2.5 | 2.6 |
| blue | 0 | 4.3 | 5.3 | 3.9 |

TABLE 2

| | change in Δ E value | | | |
|---|---|---|---|---|
| Comparative Example 1 | initial stage | after 83 hours | after 200 hours | after 330 hours |
| black | 0 | 14.0 | 36.4 | 43.0 |
| yellow | 0 | 23.5 | 51.6 | 54.0 |
| magenta | 0 | 40.2 | 65.2 | 71.8 |
| cyan | 0 | 8.5 | 14.8 | 15.5 |
| red | 0 | 28.2 | 42.4 | 45.7 |
| green | 0 | 4.8 | 7.4 | 7.9 |
| blue | 0 | 12.0 | 20.8 | 42.3 |

TABLE 3

| | change in Δ E value | | | |
|---|---|---|---|---|
| Example 2 | initial stage | after 83 hours | after 200 hours | after 330 hours |
| black | 0 | 5.3 | 10.9 | 12.1 |
| yellow | 0 | 4.4 | 9.9 | 9.4 |
| magenta | 0 | 5.1 | 13.6 | 15.8 |
| cyan | 0 | 4.3 | 8.4 | 8.7 |
| red | 0 | 6.8 | 11.7 | 14.3 |
| green | 0 | 2.6 | 2.7 | 2.9 |
| blue | 0 | 2.6 | 5.6 | 5.7 |

TABLE 4

| | change in Δ E value | | | |
|---|---|---|---|---|
| Example 3 | initial stage | after 83 hours | after 200 hours | after 330 hours |
| black | 0 | 2.7 | 8.2 | 11.4 |
| yellow | 0 | 5.1 | 10.5 | 11.0 |
| magenta | 0 | 6.0 | 14.2 | 20.0 |
| cyan | 0 | 5.1 | 9.8 | 10.0 |
| red | 0 | 6.9 | 14.8 | 16.1 |
| green | 0 | 1.1 | 4.8 | 2.9 |
| blue | 0 | 7.5 | 13.3 | 13.8 |

TABLE 5

| | change in Δ E value | | | |
|---|---|---|---|---|
| Comparative Example 2 | initial stage | after 83 hours | after 200 hours | after 330 hours |
| black | 0 | 13.7 | 31.6 | 41.9 |
| yellow | 0 | 9.6 | 28.1 | 36.4 |

TABLE 5-continued

| Comparative Example 2 | change in Δ E value initial stage | after 83 hours | after 200 hours | after 330 hours |
|---|---|---|---|---|
| magenta | 0 | 35.8 | 71.6 | 77.8 |
| cyan | 0 | 6.1 | 10.7 | 14.3 |
| red | 0 | 25.8 | 43.8 | 52.2 |
| green | 0 | 2.8 | 7.8 | 10.5 |
| blue | 0 | 18.7 | 29.6 | 35.3 |

TABLE 6

| | OD survival rate (%) Example 4 | OD survival rate (%) Example 5 |
|---|---|---|
| black | 90 | 88 |
| yellow | 87 | 85 |
| magenta | 85 | 80 |
| cyan | 87 | 96 |

What is claimed is:

1. A pressure-sensitive transferring protective covering material comprising at least (a) a first flexible substrate, (b) an adhesive layer, (c) a solid resin layer, and (d) a second flexible substrate which are stacked in the named order, wherein said first flexible substrate (a) has a peel force of 30 g/inch to 120 g/inch against said adhesive layer (b), said adhesive layer (b) contains a hindered amine series light stabilizer and has a cohesion of 500 g/inch to 1500 g/inch, said solid resin layer (c) comprises a transparent resin layer containing a ultraviolet absorber and having a glass transition temperature of 50° C. or above, and said second flexible substrate (d) has a peel force of 120 g/inch to 400 g/inch against said solid resin layer (c).

2. A pressure-sensitive transferring protective covering material according to claim 1, wherein the cohesion of the adhesive layer is in the range of 700 g/inch to 1300 g/inch.

3. A pressure-sensitive transferring protective covering material according to claim 1, wherein the hindered amine series light stabilizer contained in the adhesive layer is a hindered amine series light stabilizer in the liquid state at room temperature.

4. A pressure-sensitive transferring protective covering material according to claim 3, wherein the amount of the hindered amine series light stabilizer in the liquid state at room temperature contained in the adhesive layer is in the range of 0.3 $g/m^2$ to 3.2 $g/m^2$.

5. A pressure-sensitive transferring protective covering material according to claim 1, wherein the amount of the hindered amine series light stabilizer contained in the adhesive layer is in the range of 0.3 $g/m^2$ to 3.2 $g/m^2$.

6. A pressure-sensitive transferring protective covering material according to claim 1, wherein the amount of the ultraviolet absorber contained in the solid resin layer is in the range of 0.5 $g/m^2$ to 3.0 $g/m^2$.

7. A pressure-sensitive transferring protective covering material according to claim 1, wherein the transparent resin layer as the solid resin layer is a transparent crosslinked high molecular material layer.

8. A pressure-sensitive transferring protective covering material according to claim 7, wherein the transparent crosslinked high molecular material layer contains a crosslinking acrylic resin containing a copolymerization component comprising vinylmethoxysilane.

9. A pressure-sensitive transferring protective covering material according to claim 7, wherein the transparent crosslinked high molecular material layer is a transparent crosslinked high molecular material layer in which at least a polyol selected from the group consisting of acrylic polyol, polyester polyol and polyether polyol is crosslinked with an isocyanate.

10. A pressure-sensitive transferring protective covering material according to claim 7, wherein the transparent crosslinked high molecular material layer contains a crosslinking acrylic resin containing a copolymerization component comprising N-alkylolacrylamide.

11. A pressure-sensitive transferring protective covering material according to claim 1, wherein the adhesive layer contains an acrylic adhesive.

12. A pressure-sensitive transferring protective covering material according to claim 11, wherein the acrylic adhesive is a homopolymer having a glass transition temperature of −3° C. to −75° C.

13. A pressure-sensitive transferring protective covering material according to claim 1, wherein the adhesive layer contains an acrylic adhesive and a crosslinking agent for said adhesive.

14. A pressure-sensitive transferring protective covering material according to claim 13, wherein the acrylic adhesive is a homopolymer having a glass transition temperature of −3° C. to −75° C.

15. A pressure-sensitive transferring protective covering material according to claim 1, wherein the adhesive layer has a thickness of from 2 μm to 10 μm.

16. A pressure-sensitive transferring protective covering material according to claim 1, wherein the transparent resin layer has a glass transition temperature of 80° C. or above.

17. A pressure-sensitive transferring protective covering material according to claim 1, wherein the solid resin layer has a thickness of from 3 μm to 25 μm.

18. A pressure-sensitive transferring protective covering material according to claim 1, wherein the amount of the ultraviolet ray absorber is in the range of from 1.0 $g/m^2$ to 2.5 $g/m^2$.

19. A pressure-sensitive transferring protective covering material according to claim 1, wherein the second flexible substrate has a peel force of from 150 g/inch to 300 g/inch.

20. A method for protecting and covering a print formed on an object, said method comprising the steps of:

(i) providing a pressure-sensitive transferring protective covering material comprising at least (a) a first flexible substrate, (b) an adhesive layer, (c) a solid resin layer, and (d) a second flexible substrate which are stacked in the named order wherein said first flexible substrate (a) has a peel force of 30 g/inch to 120 g/inch against said adhesive layer (b), said adhesive layer (b) contains a hindered amine series light stabilizer and has a cohesion of 500 g/inch to 1500 g/inch, said solid resin layer (c) comprises a transparent resin layer containing an ultraviolet ray absorber and having a glass transition temperature of 50° C. or above, and said second flexible substrate (d) has a peel force of 120 g/inch to 400 g/inch against said solid resin layer (c);

(ii) peeling the first flexible substrate (a) from the adhesive layer (b):

(iii) superposing the adhesive layer (b) of the protective covering material on the print-bearing surface of the object, whereby contacting the adhesive layer to the print-bearing surface to cover the print-bearing surface; and (iv) peeling the second flexible substrate from the solid layer (c) to obtain a print product.

21. The method according to claim 20, wherein the print is a print formed of a dye.

22. The method according to claim 20, wherein the print is a print formed by an ink jet system.

23. The method according to claim 20, wherein the cohesion of the adhesive layer is in the range of 700 g/inch to 1300 g/inch.

24. The method according to claim 20, wherein the hindered amine series light stabilizer contained in the adhesive layer is a hindered amine series light stabilizer in the liquid state at room temperature.

25. The method according to claim 24, wherein the amount of the hindered amine series light stabilizer in the liquid state at room temperature contained in the adhesive layer is in the range of 0.3 $g/m^2$ to 3.2 $g/m^2$.

26. The method according to claim 20, wherein the amount of the hindered amine series light stabilizer contained in the adhesive layer is in the range of 0.3 $g/m^2$ to 3.2 $g/m^2$.

27. The method according to claim 20, wherein the amount of the ultraviolet absorber contained in the solid resin layer is in the range of 0.5 $g/m^2$ to 3.0 $g/m^2$.

28. The method according to claim 20, wherein the transparent resin layer as the solid resin layer is a transparent crosslinked high molecular material layer.

29. The method according to claim 28, wherein the transparent crosslinked high molecular material layer contains a crosslinking acrylic resin containing a copolymerization component comprising vinylmethoxysilane.

30. The method according to claim 28, wherein the transparent crosslinked high molecular material layer is a transparent crosslinked high molecular material layer in which at least a polyol selected from the group consisting of acrylic polyol, polyester polyol and polyether polyol is crosslinked with an isocyanate.

31. The method according to claim 28, wherein the transparent crosslinked high molecular material layer contains a crosslinking acrylic resin containing a copolymerization component comprising N-alkylolacrylamide.

32. The method according to claim 12, wherein the adhesive layer contains an acrylic adhesive.

33. The method according to claim 32, wherein the acrylic adhesive is a homopolymer having a glass transition temperature of −3° C. to −75° C.

34. The method according to claim 20, wherein the adhesive layer contains an acrylic adhesive and a crosslinking agent for said adhesive.

35. The method according to claim 34, wherein the acrylic adhesive is a homopolymer having a glass transition temperature of −3° C. to −75° C.

36. The method according to claim 20, wherein the adhesive layer has a thickness of from 2 $\mu$m to 10 $\mu$m.

37. The method according to claim 20, wherein the transparent resin layer has a glass transition temperature of 80° C. or above.

38. The method according to claim 20, wherein the solid resin layer has a thickness of from 3 $\mu$m to 25 $\mu$m.

39. The method according to claim 20, wherein the amount of the ultraviolet ray absorber is in the range of from 1.0 $g/m^2$ to 2.5 $g/m^2$.

40. The method according to claim 20, wherein the second flexible substrate has a peel force of from 150 g/inch to 300 g/inch.

* * * * *

UNITED STATES PATENT AND TRADEMARK OFFICE

CERTIFICATE OF CORRECTION

PATENT NO. : 5,954,906

DATED : September 21, 1999

INVENTOR(S) : TSUTOMU ABE, ET AL.

It is certified that error appears in the above-identified patent and that said Letters Patent is hereby corrected as shown below:

ON THE COVER PAGE:

Item [57] ABSTRACT

Line 11, "a ultraviolet" should read --an ultraviolet ray--.

COLUMN 2:

Line 64, "a ultraviolet" should read --an ultraviolet ray-- and "(or a" should read --(hereinafter referred to as--.

COLUMN 3:

Line 15, "ultraviolet absorber (or a UV absorber)" should read --UV absorber--.

COLUMN 5:

Line 29, "case" should read --care--.

UNITED STATES PATENT AND TRADEMARK OFFICE

CERTIFICATE OF CORRECTION

PATENT NO. : 5,954,906

DATED : September 21, 1999

INVENTOR(S) : TSUTOMU ABE, ET AL.

It is certified that error appears in the above-identified patent and that said Letters Patent is hereby corrected as shown below:

COLUMN 6:

Line 19,"cynate" should read --cyanate--.
Line 23, "introducing a carboxyly" should read --introduce a carboxyl--.

COLUMN 16:

Line 52, "pint" should read --print--.

COLUMN 21:

Line 32, "a ultraviolet" should read --an ultraviolet ray--.
Line 55, "ultraviolet" should read --ultraviolet ray--.

COLUMN 22:

Line 58, "layer (b):" should read --layer (b);--.

UNITED STATES PATENT AND TRADEMARK OFFICE

CERTIFICATE OF CORRECTION

PATENT NO. : 5,954,906

DATED : September 21, 1999

INVENTOR(S) : TSUTOMU ABE, ET AL.

It is certified that error appears in the above-identified patent and that said Letters Patent is hereby corrected as shown below:

COLUMN 23:

Line 19, "ultraviolet" should read --ultraviolet ray--.

Signed and Sealed this

First Day of May, 2001

*Attest:*

Nicholas P. Godici

NICHOLAS P. GODICI

*Attesting Officer*

*Acting Director of the United States Patent and Trademark Office*